United States Patent [19]

Zien

[11] 4,373,522

[45] Feb. 15, 1983

[54] EMERGENCY FRESH AIR SUPPLY DEVICE

[75] Inventor: Allen S. Zien, Bayside, Wis.

[73] Assignee: Zien Mechanical Contractors, Milwaukee, Wis.

[21] Appl. No.: 288,909

[22] Filed: Jul. 31, 1981

[51] Int. Cl.[3] ..... A62B 7/00

[52] U.S. Cl. ..... 128/206.12; 128/202.13; 128/200.24

[58] Field of Search ..... 128/200.24, 201.22–201.29, 128/202.13, 102.19, 204.18, 205.25, 206.12, 206.27, 206.28, 207.12, 202.27, 205.24, 205.26, 205.28, 206.15, 206.21; 98/1.5, 2, 33 R; 244/118.5

[56] References Cited

U.S. PATENT DOCUMENTS

| | | | |
|---|---|---|---|
| 77,168 | 4/1868 | Chapman . | |
| 818,484 | 3/1906 | Velschow . | |
| 1,040,311 | 10/1912 | Halloran . | |
| 1,263,595 | 4/1918 | Nordstrom et al. | 128/207.13 |
| 2,917,987 | 2/1957 | Hansen et al. . | |
| 4,165,738 | 8/1979 | Graves et al. . | |
| 4,331,139 | 5/1982 | Popa | 128/206.12 |

*Primary Examiner*—Henry J. Recla

*Attorney, Agent, or Firm*—Andrus, Sceales, Starke & Sawall

[57] ABSTRACT

An openable face mask storage chamber is mounted on the inner side of an outer building wall. The mask or masks are connected through tubing to fresh air supplied through a conduit extending through the building wall to the outside. A closure cap is disposed on the outer conduit end and is actuatable from inside the storage chamber to open and permit fresh air to enter the conduit. The closure cap, when open, functions as a baffle to force smoke or the like which is rising up along the building's outside wall away from the mouth of the conduit. Furthermore, an alert device is triggered by opening of the closure cap and which is perceivable by outsiders to warn them that people in the room are in danger.

11 Claims, 4 Drawing Figures

EMERGENCY FRESH AIR SUPPLY DEVICE

U.S. PRIOR ART OF INTEREST

Ser. No. 77,168 Chapman Apr. 28, 1868;
Ser. No. 814,484 Velschow Mar. 06, 1906;
Ser. No. 839,486 Lafave Dec. 25, 1906;
Ser. No. 1,040,311 Halloran Oct. 08, 1912;
Ser. No. 2,299,793 Cannaday et al. Oct. 27, 1942;
Ser. No. 2,917,987 Hansen et al. Dec. 22, 1959;
Ser. No. 4,165,738 Graves et al. Aug. 28, 1979.

BACKGROUND AND SUMMARY OF THE INVENTION

This invention relates to an emergency fresh air supply device.

It is becoming more commonly known that many fatalities occurring in fires are caused by smoke and accompanying gases rather than the flames themselves. Occupants of rooms in any building, whether low rise or high rise, may be overcome by smoke, even though no flames are present, and before they are able to escape.

Various life-saving or life-support systems which provide air to one or more persons as needed are disclosed in some of the above-identified patents. However, these systems are primarily for use in evironments different than that contemplated here.

It is a task of the present invention to provide an emergency fresh air supply to one or more persons in the outside room of a building. It is a further task to reduce the mixing of smoke or noxious gases, which may be present outside the building and closely adjacent the building wall, with the emergency fresh air supply. It is yet another task to provide an automatic signal to outsiders of the presence of a person or persons in the room who are having to resort to the emergency system in order to breathe.

In accordance with the various aspects of the invention, an openable face mask storage chamber is mounted on the inner side of an outer building wall. The mask or masks are connected through tubing to fresh air supplied through a conduit extending through the building wall to the outside. A closure cap is disposed on the outer conduit end and is actuatable from inside the storage chamber to open and permit fresh air to enter the conduit. The closure cap, when open, functions as a baffle to force smoke or the like which is rising up along the building's outside wall away from the mouth of the conduit. Furthermore, an alert device is triggered by opening of the closure cap and which is perceivable by outsiders to warn them that people in the room are in danger.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
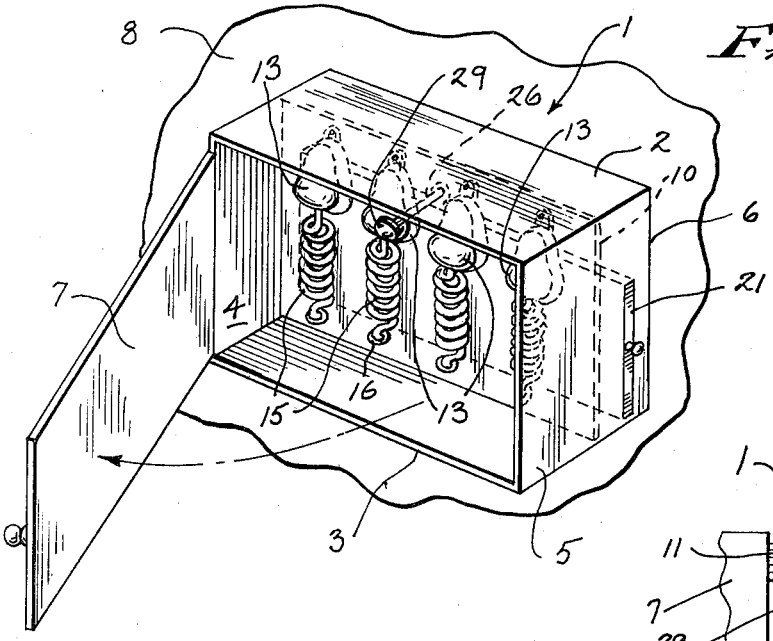
FIG. 1 is a perspective view of an open face mask storage chamber, as viewed from within a room, and which is constructed in accordance with the various aspects of the invention.
Figure 2:
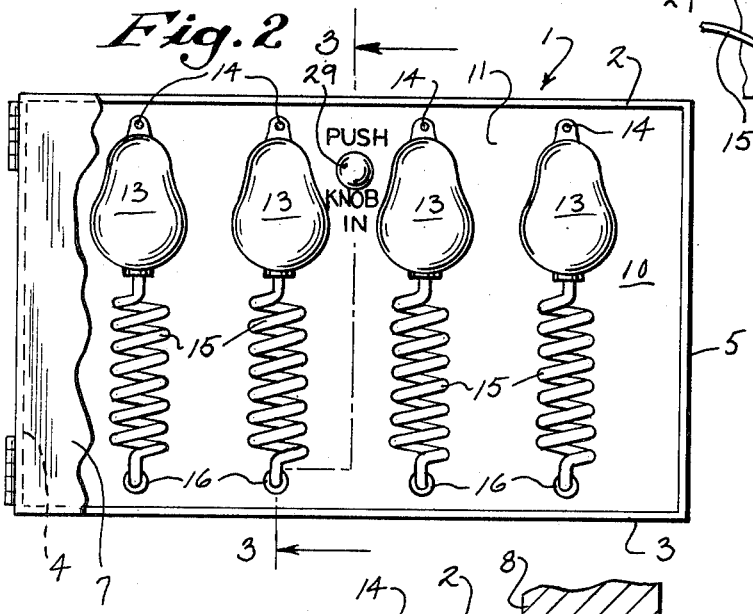
FIG. 2 is a front elevation of the chamber.

As shown in the drawings, the emergency fresh air supply device includes a housing 1 having top and bottom walls 2 and 3, end walls 4 and 5, a rear wall 6, as well as a front wall 7 which is manually openable to form an access door. Housing 1 is adapted to extend into the room to be protected and is adapted to be mounted to the inner face 8 of an outside room wall 9 in any suitable manner, not shown.

A vertical partition 10 is disposed between walls 6 and 7 is sealingly mounted to walls 2, 3, 4 and 5. There is thus formed a front storage chamber 11 and a rear fresh air chamber 12.

Storage chamber 11 is adapted to contain one or more face masks 13, four being illustrated, which can be hung on suitable hooks 14 secured to partition 10. Masks 13 are connected to coiled extendable air hoses 15 which extend through annular sealing gaskets 16 surrounding suitable openings 17 in partition 10 for communication with fresh air chamber 12.

Chamber 12 is connected to outside fresh air through an opening 18 in rear wall 6 and an access conduit 19 which is adapted to extend from opening 18 and outwardly through a passage in wall 9 to the outside adjacent the outer face 20 of the wall. Air passing in through conduit 19 to fresh air chamber 12 may be cleansed by a transversely removable filter 21 which extends across opening 18 within chamber 12 and which is held in position by upper and lower guides 22 and 23.

Figure 4:
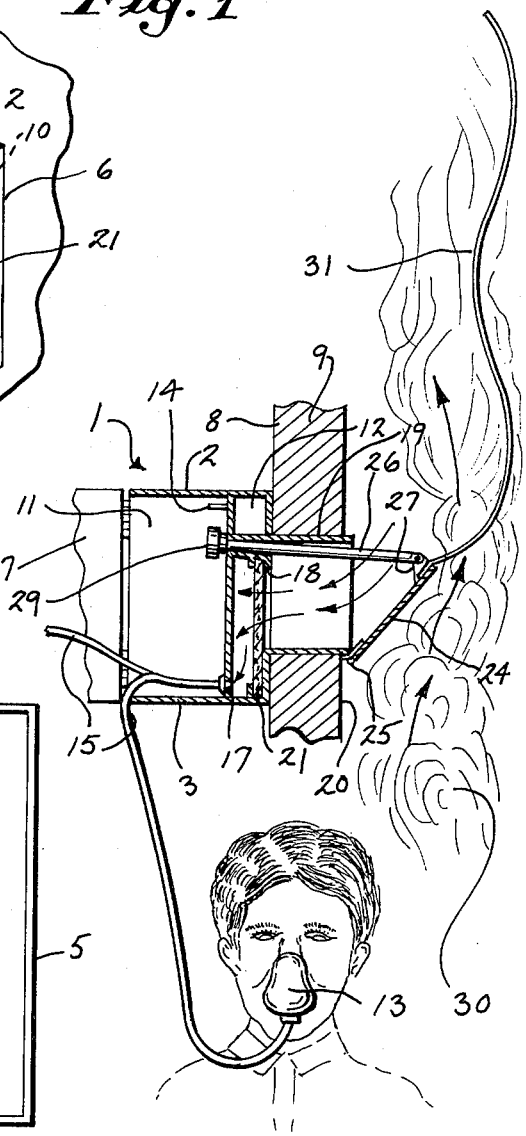
FIG. 4 is a view similar to FIG. 3 and showing the device in use.
Figure 3:
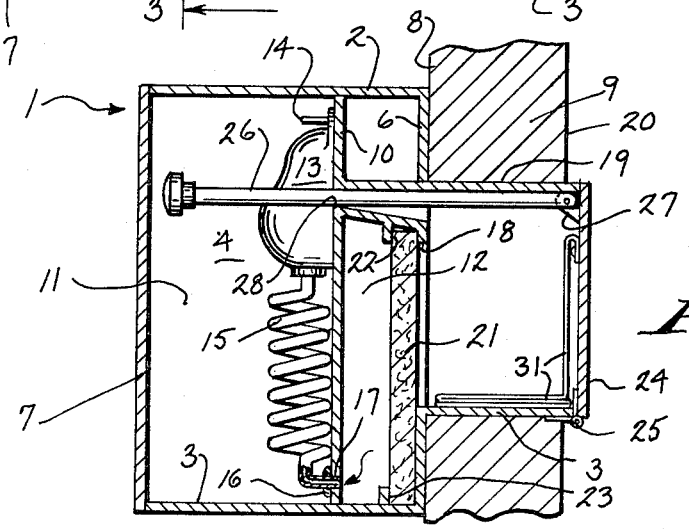
FIG. 3 is a transverse section taken on line 3—3 of FIG. 2 and showing the device in closed inoperative condition.

The outer end or inlet mouth of conduit 19 is normally closed to the outside air by a closure cap 24 which is shown as pivotally mounted along its lower edge to conduit 19, as at hinge 25. Means for selectively opening and closing cap 24 are provided, and in the present embodiment comprises a manually actuatable pushrod 26. Pushrod 26 is pivotally connected at its outer end to a bracket 27 mounted on the upper face of cap 24, and extends inwardly through an opening 28 in partition 10 to ultimately terminate in a knob 29 within storage chamber 11. When pushrod 26 is in its inwardly extended position, as shown in FIGS. 1 and 3, cap 24 will be in its normally closed position. When pushrod 26 is pushed to its outwardly extended position, as shown in FIG. 4, cap 24 will pivot outwardly and downwardly to its opened position to permit fresh air to enter and pass through conduit 19 into chamber 12.

In the event of a fire or smoke emergency and wherein the person or persons in the room cannot escape, door 7 is manually opened, revealing chamber 11. Knob 29 is pushed to open cap 24 so that fresh outside air is made available through chamber 12 and hoses 15 to face masks 13. As shown in FIG. 4, hoses 15 are extended, a mask 13 is placed over the face to provide fresh breathable air from the outside, and the person or persons may safely await rescue without being overcome by smoke or noxious gases within the room.

It would be preferable to place housing 1 low on wall 9 so that a person or persons wearing a mask will not have to stand up and can sit in a chair.

In some instances, such as in high rise fires, smoke and the like 30 may risingly billow up along the outer face 20 of wall 9 from below the room equipped with the device of the invention. Such smoke could then enter the mouth of conduit 19 and destroy the life-saving effectiveness of the device. To prevent this, upwardly and outwardly extending baffle means are positioned adjacent conduit 19 to force smoke 30 away from the air inlet. As shown in FIG. 4, closure cap 24 provides such baffle means by reason of its extending upwardly and outwardly in an inclined fashion, when open, from hinge 25 at the lower edge of the mouth of conduit 19 and in front ot the conduit inlet.

In addition, an alert means is provided to notify outsiders that there are people in trouble in that particular part of the building. The alert means functions as a locator. Referring to FIGS. 3 and 4, an elongated flexible ribbon 31 is secured at one end to the upper inner wall portion of closure cap 24, as at 32. As shown in FIG. 3, ribbon 31, which should be of a bright color, is normally folded and stored within the chamber formed by conduit 19 when cap 24 is closed. When cap 24 is opened, as in FIG. 4, ribbon 31 will in response be pulled out of conduit 19. In the presence of upward air drafts, ribbon 31 will billow upwardly like a flag, as shown. If no upward air drafts are present, ribbon 31 will hang downwardly over cap 24. In either event, ribbon 31 forms a visual alert locator means to warn people outside the building of the presence of people in the room adjacent the device, so that rescue can be attempted.

The device of the invention eliminates the need for breaking a window, which in some instances can create a dangerous chimney effect which pulls smoke through the room from the building interior, and which also creates a danger from falling glass.

Various modes of carrying out the invention are contemplated as being within the scope of the following claims particularly pointing out and distincly claiming the subject matter which is regarded as the invention.

I claim:

1. An emergency fresh air supply device for people in a building room having an outside wall, comprising in combination:

(a) housing means defining a storage chamber and an air chamber and adapted to be fixedly mounted on the inner side of said outside wall, and with said housing means being openable from the room side, (b) a fresh air conduit connected to said air chamber of said housing means and adapted to extend outwardly therefrom through the said building wall to form a fresh air inlet mouth on the outer side of said wall, (c) at least one face mask removably disposed within said storage chamber of said housing means and with said mask being connected to said conduit, (d) and a closure cap disposed at said inlet mouth of said conduit for normally closing said conduit to outside air.

2. The device of claim 1 which includes means for selectively moving said closure cap to open said conduit inlet mouth to outside air.

3. The device of claim 2 wherein said closure cap moving means comprises a pushrod pivotally connected at its outer end to said closure cap and with said pushrod extending inwardly through said conduit and into said housing means.

4. The device of claim 2 wherein said closure cap, when in its opened position, forms a baffle to force smoke or the like billowing upwardly along the outside of the building wall away from the said inlet mouth of said conduit.

5. The device of claim 4 wherein the lower portion of said closure cap is pivotally mounted to the lower portion of said conduit and inclines outwardly and upwardly in front of said inlet mouth when said cap is in its opened position.

6. The device of claim 2 or 4 which includes locator means actuated in response to moving of said closure cap to provide an alert to outsiders that the said device is in use.

7. The device of claim 6 wherein said locator means comprises a locator element which is visually observable from outside the building.

8. The device of claim 7 wherein said locator element is attached to said closure cap.

9. The device of claim 8 wherein said conduit comprises means for storing said locator element when said closure cap is in its normal conduit-closing position.

10. The device of claim 9 wherein said locator element comprises a flexible ribbon.

11. An emergency fresh air supply device for people in a building room having an outside wall, comprising in combination:

(a) housing means adapted to be fixedly mounted on the inner side of the said outside wall, and with said housing means being openable from the room side and having a storage chamber and a fresh air chamber, (b) at least one face mask removably disposed in said storage chamber, and with said mask being connected to said fresh air chamber, (c) a fresh air conduit connected to said fresh air chamber and adapted to extend outwardly therefrom through the said building wall to form a fresh air inlet mouth on the outer side of the said wall, (d) and a closure cap disposed at said inlet mouth of said conduit for normally closing said conduit to outside air.

* * * * *

UNITED STATES PATENT AND TRADEMARK OFFICE

CERTIFICATE OF CORRECTION

PATENT NO. : 4,373,522

DATED : February 15, 1983

INVENTOR(S) : Allen S. Zien

It is certified that error appears in the above-identified patent and that said Letters Patent is hereby corrected as shown below:

On the title page, under "References Cited; U.S. Patent Documents":

Delete "818,484 3/1906 Velschow" and substitute therefor ---814,484 3/1906 Velschow---

Add the following references:

---- 839,486 12/1905 Lafave
2,299,793 10/1942 Cannaday et al.----

Column 1, Lines 5 through 11, Delete "Ser. No." in every instance and substitute therefor ----Patent No.----

Column 2, Line 15, After the numeral "7" insert ----and----

Column 2, Line 41, After "upper" insert ----inner----.

Signed and Sealed this

*Seventeenth* Day of *May 1983*

[SEAL]

*Attest:*

DONALD J. QUIGG

*Attesting Officer*

*Acting Commissioner of Patents and Trademarks*